United States Patent [19]

Besic

[11] Patent Number: 4,921,409

[45] Date of Patent: May 1, 1990

[54] HIGH PRESSURE RECIPROCATING PUMP

[75] Inventor: Dragan Besic, West Caldwell, N.J.

[73] Assignee: Dresser Industries, Inc., Dallas, Tex.

[21] Appl. No.: 209,698

[22] Filed: Jun. 21, 1988

[51] Int. Cl.[5] ..... F04B 21/00

[52] U.S. Cl. ..... 417/552; 417/570

[58] Field of Search ..... 417/552, 549, 545, 550, 417/570, 553; 137/538

[56] References Cited

U.S. PATENT DOCUMENTS

| | | | |
|---|---|---|---|
| 214,769 | 4/1879 | Garrison | 417/558 |
| 384,633 | 6/1888 | Lourie | 417/552 |
| 718,771 | 1/1903 | Kerfoot | 417/553 |
| 740,892 | 10/1903 | Meyer | 417/558 |
| 811,181 | 1/1906 | Sterne | 417/570 |
| 866,832 | 9/1907 | Whitaker | 417/558 |
| 898,659 | 9/1908 | Kuehl | 417/552 |
| 1,663,737 | 3/1928 | Thompson | 417/552 |
| 2,862,450 | 12/1958 | McDonnell | 417/417 |
| 3,125,119 | 3/1964 | Righgels | 137/538 |
| 4,239,463 | 12/1980 | Yaindl | 417/454 |
| 4,688,999 | 8/1987 | Ames et al. | 417/550 |

FOREIGN PATENT DOCUMENTS

| | | |
|---|---|---|
| 430663 | 6/1935 | United Kingdom . |
| 611057 | 10/1948 | United Kingdom . |
| 1225263 | 3/1971 | United Kingdom . |
| 1277799 | 6/1972 | United Kingdom . |

OTHER PUBLICATIONS

"JSW Plunger Pump", Japan Steel Works Co., Ltd., date unknown.

*Primary Examiner*—Leonard E. Smith
*Assistant Examiner*—Robert N. Blackmon

[57] ABSTRACT

An improvement in high pressure reciprocating plunger pumps is disclosed which is characterized by a small residual volume and mechanical simplicity. The plunger is provided with a central bore which carries fluid to or from a valve located at the terminal end of the plunger. This valve may be either an intake or discharge valve. Another valve is provided with access to the pumping chamber. This second valve has a tapered exterior surface which is adapted to press-fitting and hydraulic removal. Both valve actuation movements are colinear with the direction of plunger travel.

8 Claims, 3 Drawing Sheets

HIGH PRESSURE RECIPROCATING PUMP

BACKGROUND OF THE INVENTION

Prior art outboard packed reciprocating plunger pumps are generally characterized by "T" or "L" shaped liquid ends. The liquid end consists of the stuffing box, pumping chamber, valve assemblies, suction and discharge manifolds. The pumping chamber normally includes intersecting valve passages and plunger bore. The arrangement of intersecting valve passages and plunger bore creates localized areas of high stress, considered limiting factors in the pressure at which the pump could operate. In addition, when valve assemblies are mounted on each side of the plunger bore, the minimum close clearance or residual of the pumping chamber is directly dependent on the physical size of the valve assemblies. The effect of high suction pressures on crosshead pin bushings is a source of lubrication problems in prior art designs. Traditional designs are also limited by the many connections and fasteners which require disassembly during maintenance.

SUMMARY OF THE INVENTION

The deficiencies of prior art pumps are remedied, and additional benefits are conferred by providing a simplified liquid end having a novel arrangement of valves. A first resiliently biased valve is located within a hollow terminal portion of a plunger. A second resiliently biased valve is located adjacent the pumping chamber and is oriented in substantial coaxial alignment with the first valve. The reciprocal movement of the plunger creates a pressure fluctuation within the pumping chamber; first actuating one valve to fill the chamber, then actuating the other to drain the chamber. The direction of fluid flow depends only on the valve logic. When the suction valve is located within the plunger, fluid is drawn through the plunger and into the pumping chamber. If the discharge valve is located within the plunger, fluid is drawn into the pumping chamber and discharged via the hollow portion of the plunger.

Because the first valve is at least partially recessed within the plunger, the residual volume of the pumping chamber is very small. This is a great benefit in pumping compressible fluids at high pressures. The design of the present invention distributes stresses in the pumping chamber evenly, which allows for potentially higher pumping pressures than previous designs. Because it is mechanically simple, it is reliable and easy to maintain.

DESCRIPTION OF THE PREFERRED EMBODIMENT

Example A

Figure 1:
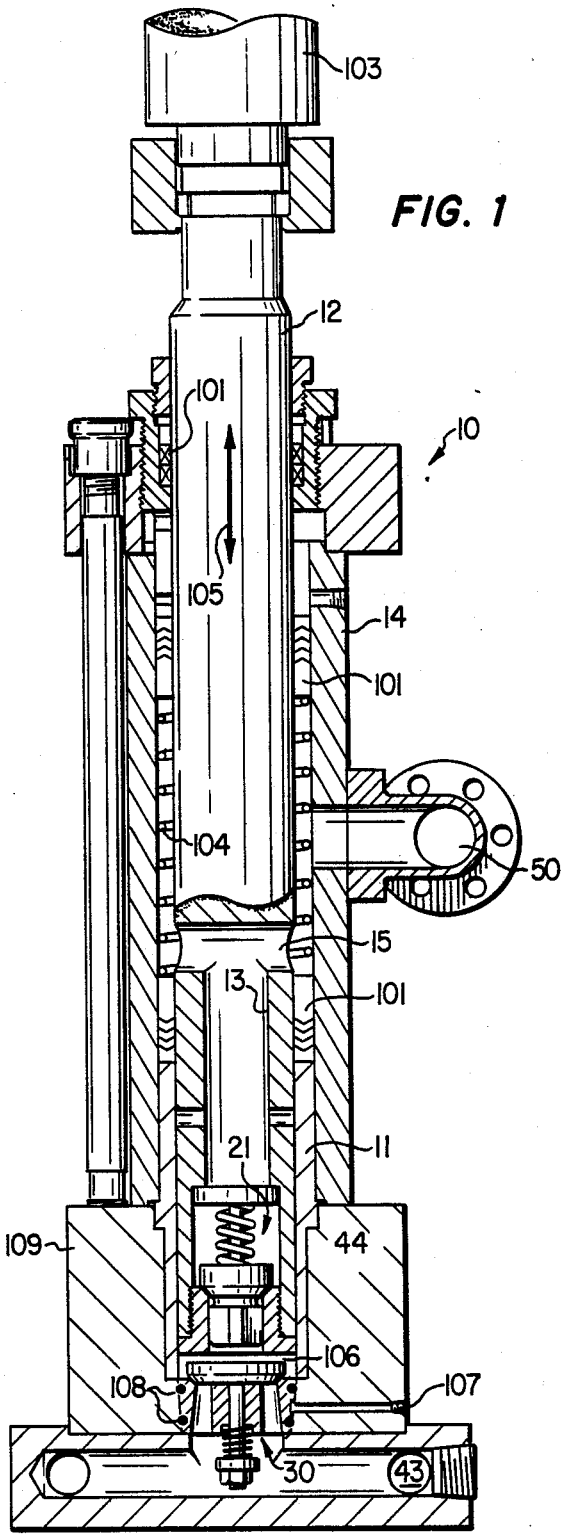
FIG. 1 is a partial cross section of a vertical plunger pump incorporating the improvements of the present invention.

As shown in FIG. 1, the improved vertical plunger pump 10 of the present invention generally includes one or more plungers 12 which are attached to reciprocating crossheads 103. Various seals 101 are interposed between the plunger 12 and the individual stuffing box barrels 14. A spring 104 keeps the seals in position. The throat bushing 11 is located between the plunger and the stuffing box barrel 14. The plunger has a central bore 13 at the terminal end. The bore has a discharge 15 at one extremity which feeds into the pump discharge manifold 50 via the space between the plunger and the stuffing box barrel. The discharge opening 15 is said to intersect the bore 13. The other end of the plunger bore terminates in an enlarged section 44 into which the discharge valve 21 is situated. The pumping chamber 106 is defined by the space between the discharge valve 21 and the suction valve 30. The suction valve 30 is in the form of a tapered plug or core which is pressed into an opening in the liquid cylinder 109 of the pump. A small hydraulic feed line 107 is provided, through which high pressure hydraulic fluid may be introduced for the purpose of removing the suction valve for maintenance purposes. Fluid is supplied to the suction valve 30 by an inlet 43.

Note that the plunger moves along its own central longitudinal axis in the direction of the arrow 105. As will be explained, moving parts in the suction and discharge valves also move in this direction. It can be said, therefore, that the axes of actuation of both valves are parallel to the central axis of the plunger. It should also be noted that in the case of the examples given here, the valves and plunger share a common centrally located or colinear axis of symmetry. This alignment of the valves is considered efficient and space saving because it allows large valve openings but also allows for a small residual volume in the pumping chamber. Seals 108 are provided between the suction valve 30 and the liquid cylinder 109.

Figure 2:
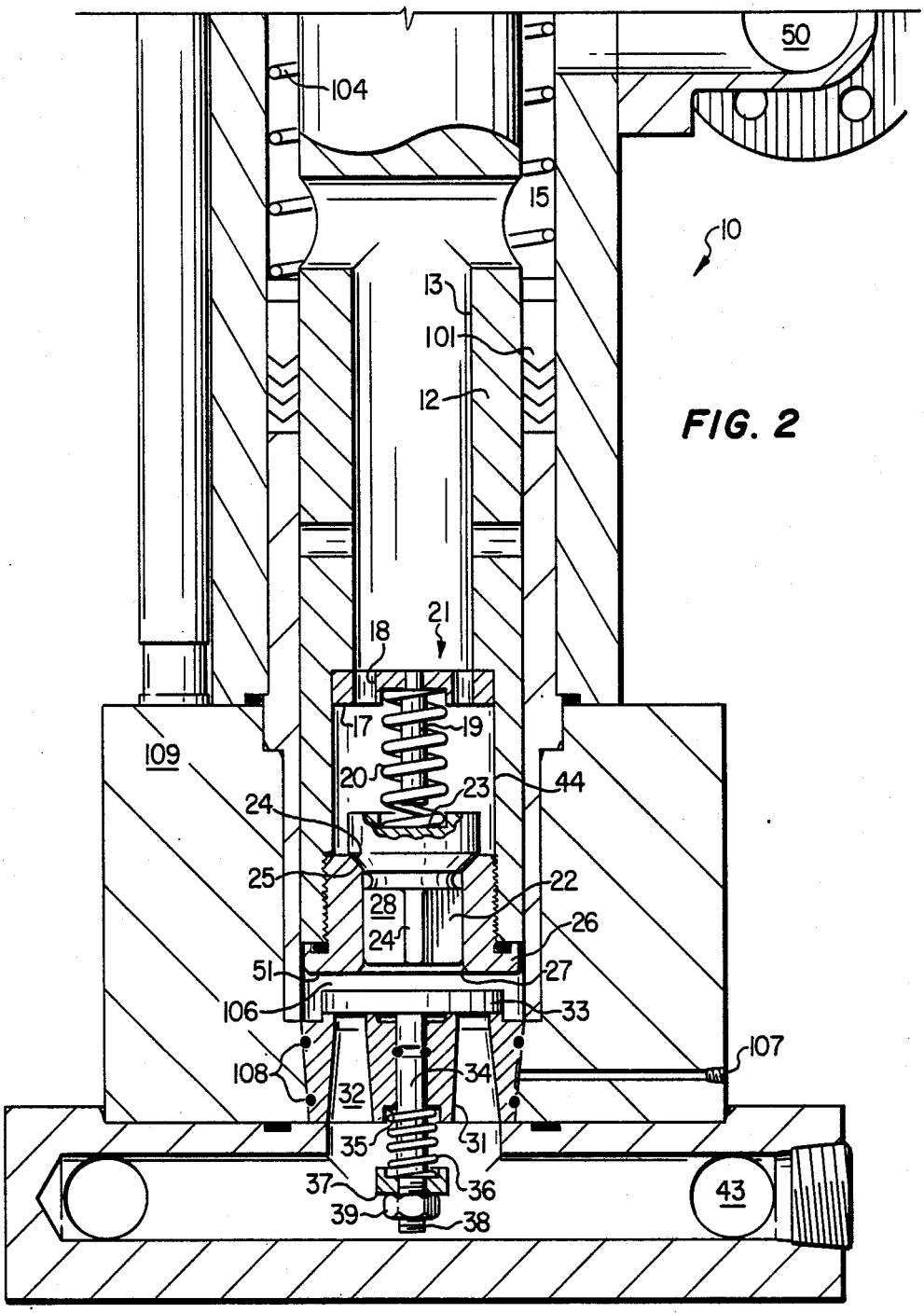
FIG. 2 is a partial cross section of the pump depicted in FIG. 1, showing more clearly the improvements of the present invention. In this figure, the discharge valve is mounted within the plunger.

FIG. 2 shows in more detail the improved suction and discharge valve assemblies. The apparatus is shown at the beginning of the intake stroke of the pump. It should be remembered that this position also corresponds to the end of the discharge stroke. As the plunger moves upwardly and away from the suction valve 30, fluid enters the inlet 43 and is drawn through axial passages or openings 32 in the tapered suction valve core 31. This causes lifting of the suction valve cover plate 33 which is joined to a stem 34. The lifting of the cover plate 33 occurs against the resilient bias imposed by a spring 36 which is retained at one end by a shoulder 35 formed on the core 31 and at the other, by a nut 39 and retainer 37 which cooperate with a threaded end 38 on the stem 34. The cover plate advances toward the plunger 12 as the plunger recedes, thereby admitting fluid into the pumping chamber 106.

At the end of the intake stroke, the plunger reaches its maximum travel and therefore the suction valve spring 36 is able to overcome the negative pressure in the pumping chamber caused by plunger withdrawal. The action of the suction valve spring returns the cover plate 33 to its seated position.

The discharge stroke of the plunger begins as the plunger descends toward the suction valve 30 which now seals the inlet 43 from positive pressure in the pumping chamber 106. Pressure accumulation in the pumping chamber acts to lift the discharge valve element 22 against the bias of the discharge valve spring 20. The discharge valve spring 20 is restrained at one end by a recess 23 in the element 22, and at the other end by the discharge valve retainer 17. The retainer 17 has openings 18 which allow fluid to flow into the bore 13. A mechanical stop 19 is held by the retainer and limits the movement of the element 22 while also preventing the escape of the spring 20. Fluid flows around the element 22 during the discharge stroke via external passages 28 separated from one another by the radial fins or guides 29 which locate the element 22 with respect to the discharge valve seating member 26. The face 51 of the seating member 26 which faces the pumping chamber forms the terminal end of the plunger.

At the end of the discharge stroke, the plunger has returned to its initial position, proximal to the suction valve as shown in FIG. 2. At this point, the bias exerted by the discharge valve spring 20 overcomes the force exerted on the element 22 by fluid pressure in the pumping chamber. This causes resealing of the element 22 with respect to the seating member 26 as a tapered shoulder 24 on the element 22 engages a matched tapered seat 25 formed in the sealing member 26. This once again seals the plunger bore 13 from the pumping chamber 106.

As can be appreciated from this description in conjunction with the illustration of FIG. 2, the residual or undelivered volume of the pumping chamber is minimized. In addition, the simplified valving causes pumping stresses to be felt by the apparatus primarily as simple, easily accommodated hoop stresses.

Maintenance on the suction valve is simplified because the tapered suction valve core 31 is press fit into a like-tapered bore in the liquid cylinder 109. Removal of the suction valve is facilitated by introducing high pressure hydraulic fluid into the conduit 107. The pressure which accumulates between the seals 108 is capable of ejecting the valve 30.

Example B

Figure 3:
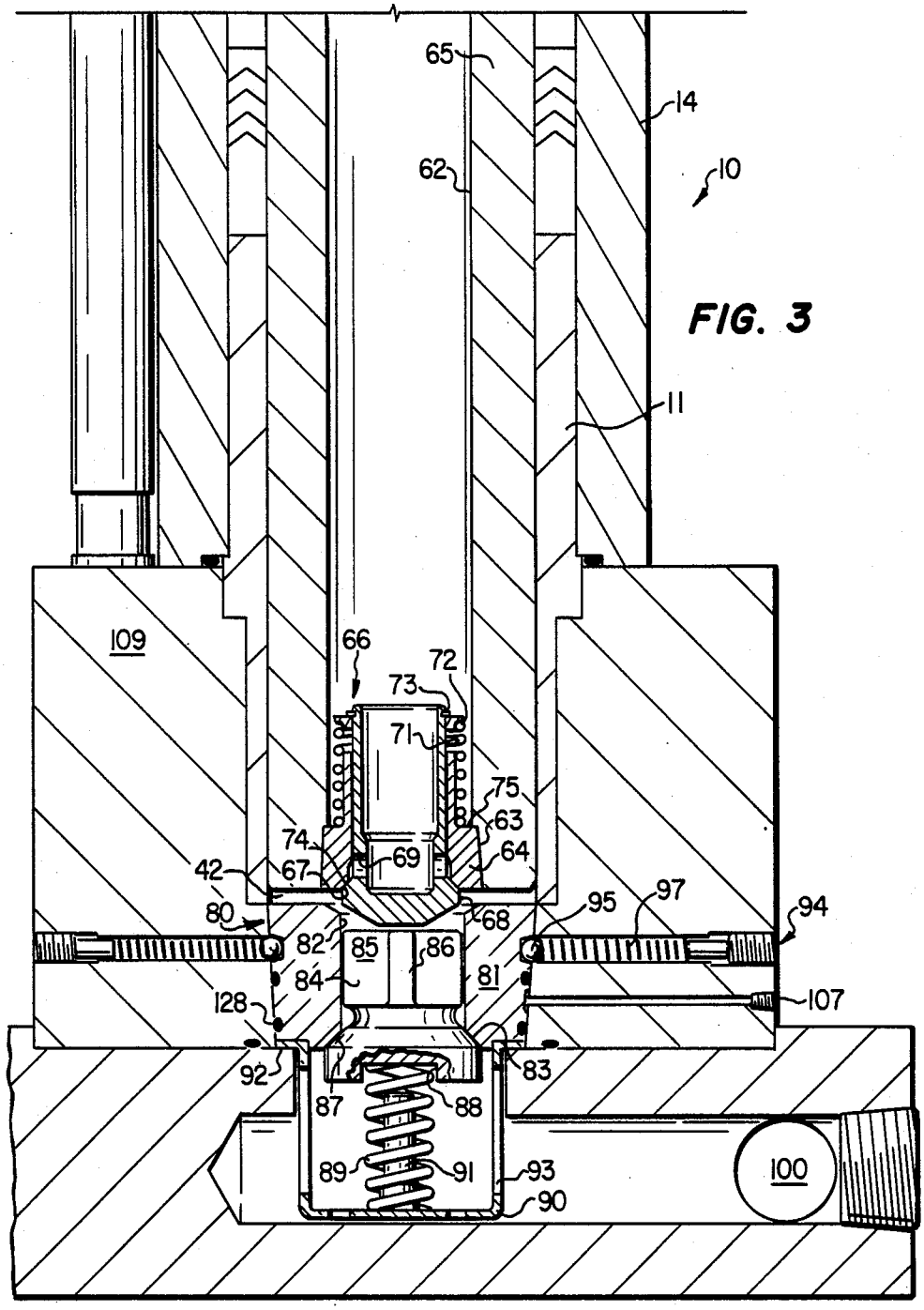
FIG. 3 is a partial cross section of an alternate style of achieving the beneficial results of the present invention where the suction valve is mounted within the plunger.

An alternate way of achieving the beneficial results of the present invention is shown in FIG. 3. In principle, this embodiment is similar to the apparatus shown in FIGS. 1 and 2; however, in this case, the suction valve 66 has been located within an enlarged portion 63 in the plunger bore 62 and the discharge valve 80 is located in the liquid cylinder 109.

At the start of the intake stroke, as shown in FIG. 3, a tapered seat 67 on the cylindrical intake valve core 68 is urged against a matching seat 74 on the suction or intake valve seating member 64, by a spring 71. The spring is secured at one end by a shoulder 75 on the seating member, and at the other, by a flange 72 and a retaining ring 73. The seating member 64 is carried by an enlarged portion 63 of the plunger bore 62.

Movement of the plunger away from the discharge valve 80, during the intake stroke, causes a pressure differential across the suction valve core 68. The pressure overcomes the bias imposed by the spring 71. This results in the core 68 moving away from the seating member 64 and towards the discharge valve 80.

Accordingly, fluid which has entered the plunger bore 62 from intake manifold and plunger inlet 61 flows through the suction valve passageway 70, and radial bypass openings 69 in the valve core 68. This fluid enters the pumping chamber 42.

At the end of the intake stroke, the pressure differential is equilibrated and the suction valve core 68 reseals against the seating member 64.

The discharge stroke begins with movement of the plunger downward or towards the discharge valve 80. Accumulating fluid pressure in the pumping chamber unseats a tapered shoulder 87 on the discharge valve element 84 from a matching taper 83 on the core 81. The element 84 moves against the bias imposed by the discharge valve spring 89. The spring 89 is retained at one end by a recess 88 in the element 84. The other end of the spring rests against a cage 90 which has a flange 92 positioned between the discharge valve core 81 and the liquid cylinder 109. A keeper 91 carried by the cage 90 limits the travel of the valve element 84 and helps retain the spring 91.

During the discharge stroke, fluid is forced from the pumping chamber 42. It flows through exterior passageways 85 on the discharge valve element 84, which are separated from one another by radial fins or guides 86. This fluid flows past the open valve seats 83, 87 through openings 93 in the cage, and finally, through the discharge port 100.

Removal of the tapered discharge valve 80 is facilitated, as previously mentioned, by the provision of hydraulic removal means consisting of a conduit 107 and seals 128. Because of the tapered interface between the discharge valve 80 and the liquid cylinder 109, a high fluid pressure exerted between the interface, via the conduit 107, exerts an axial component of force between the tapered interface, thereby enabling removal of the discharge valve 80 from the liquid cylinder 109. In addition, a ball and detent retainer 94 may be provided in the form of a ball 95 which is urged against a detent groove 96 in the valve core 81 by springs 97.

While the principles of the present invention have been described in terms of specific parts and equipment, it is to be understood that this description is made only by way of example and not as a limitation to the scope of the invention a set forth in the accompanying claims.

What is claimed is:

1. In a reciprocating pump having a plunger and a pumping chamber, the improvement comprising:

the plunger having a bore communicating with an intersecting opening and wherein the plunger includes a central axis;

a suction valve and a discharge valve, each having an axis of actuation parallel to a central axis of the plunger;

said suction valve comprising a cylindrical core having a central passageway, and said core is slidably received by a seating member and resiliently biased to said seating member, said core having one or more radially disposed openings which communicate with the central passageway, and said suction valve being attached to said plunger and cooperating with the plunger bore; and said discharge valve includes an element having a tapered sealing shoulder and projecting guides.

2. The improved plunger pump of claim 1 wherein:

the discharge valve is adjacent to a cage having affixed thereto a means for resiliently biasing the discharge valve element towards the pumping chamber.

3. The improved plunger pump of claim 2 wherein:

the discharge valve further comprises a cylinder core having a tapered exterior surface and a central passageway in which the discharge valve element is slidably received.

4. The improved plunger pump of claim 3 wherein:

the suction and discharge valves have a common axis of symmetry which is colinear to the central axis of the plunger.

5. In a reciprocating plunger pump having a plunger, a pumping chamber, a cylinder case, a liquid cylinder and a lower case, the improvement comprising:

means for fixing said cylinder case to said liquid cylinder so that respective central openings therein are aligned along a longitudinal axis;

a cylindrical thrust bushing received in the central opening of said cylinder case and said liquid cylinder, said plunger reciprocating in said thrust bushing;

a central bore formed in the plunger, the bore having an inlet at one end and an enlarged portion at the other, the enlarged portion receiving an intake valve;

the intake valve comprising a cylindrical intake valve seating member, the seating member slidably receiving an intake valve core, the intake valve core further comprising a central passageway and one or more radially disposed bypass openings;

the liquid cylinder having formed therein a tapered opening into which is press-fit a tapered discharge valve;

the discharge valve comprising a tapered core having a central opening which slidably receives a discharge valve element having radially disposed guides;

a discharge valve bias spring assembly, including a cage having an annular flange, said cage housing a spring; and said lower case being sealed to said liquid cylinder, and including a recessed area for receiving therein said bias spring assembly for biasing said discharge valve, said annular flange of said bias spring cage being captured between said tapered core and said lower case, said cage having openings for allowing compressed fluid to be discharged therethrough and out of a discharge port formed in said lower case.

6. In a reciprocating plunger pump having a plunger, a pumping chamber and a liquid cylinder, the improvement comprising:

a central bore formed in the plunger, the bore having an inlet at one end and an enlarged portion at the other, the enlarged portion receiving an intake valve;

the intake valve comprising a tapered intake valve seating member, the seating member slidably receiving an intake valve core, the intake valve core further comprising a central passageway and one or more radially disposed bypass openings;

a liquid cylinder having formed therein a tapered opening into which is press-fit a tapered discharge valve;

the discharge valve comprising a tapered core having a central opening which slidably receives a discharge valve element having radially disposed guides; and the liquid cylinder further includes a conduit formed through a sidewall thereof and which extends to the tapered opening that receives said tapered discharge valve, the conduit adapted to carry an externally applied high pressure fluid to the tapered opening for the purpose of hydraulic removal of the tapered discharge valve.

7. The improved reciprocating pump of claim 6, further including a depression in said discharge valve core aligned with a channel in said liquid cylinder, and including a ball held partially in said depression between said core and said liquid cylinder for preventing removal of the core from the liquid cylinder.

8. In a reciprocating plunger pump having a plunger and a pumping chamber, the improvement comprising:

the plunger having a bore with an outwardly tapered opening in an end thereof, the bore communicating with an intersecting opening, the plunger also having a central axis;

a suction valve and a discharge valve, each having an axis of actuation parallel to the central axis of the plunger;

said suction valve including a seating member with an external taper fixed within the tapered plunger bore, and including an internal tapered seat, said suction valve further including a core slidably received and spring biased within said seating member and including a seat cooperating with the seating member seat;

said suction valve core including a central passageway, and one or more radially disposed openings which communicate with the central passageway;

said discharge valve including a valve core with an external taper fixed within a corresponding tapered opening of a discharge part of said pump, and including an internal tapered seat, said discharge valve further including a discharge valve element spring biased within said discharge valve core, and including a seat cooperating with the seat in the discharge valve core; and the external tapers of said suction valve seating member and said discharge valve core being angled so that on a pumping stroke of said pump, said seating member and said discharge valve core are pressed with the respective tapers of the plunger and the discharge part of said pump.

* * * * *

UNITED STATES PATENT AND TRADEMARK OFFICE

CERTIFICATE OF CORRECTION

PATENT NO. : 4,921,409

DATED : May 1, 1990

INVENTOR(S) : Dragan Besic

It is certified that error appears in the above-identified patent and that said Letters Patent is hereby corrected as shown below:

Column 1, after the title "HIGH PRESSURE RECIPROCATING PUMP" insert subtitle --TECHNICAL FIELD-- and paragraph --This invention pertains to improvements in high pressure reciprocating pumps, and more particularly to a novel arrangment of valve assemblies, whereby either the suction or discharge valve is mounted on the plunger.--.

Signed and Sealed this

Twenty-seventh Day of August, 1991

*Attest:*

*Attesting Officer*

HARRY F. MANBECK, JR.

*Commissioner of Patents and Trademarks*